United States Patent [19]

Moore et al.

[11] Patent Number: 4,688,499

[45] Date of Patent: Aug. 25, 1987

[54] APPARATUS FOR AUTOMATICALLY FABRICATING TEXTILE ARTICLES SUCH AS BATH THROW RUGS AND THE LIKE

[75] Inventors: Lawrence C. Moore, Huntersville, N.C.; Freddy M. Hibdon, Murfreesboro, Tenn.; James M. Howell, Nashville, Tenn.; James E. Blalock, Franklin, Tenn.

[73] Assignee: Collins & Aikman Corporation, New York, N.Y.

[21] Appl. No.: 936,168

[22] Filed: Dec. 1, 1986

[51] Int. Cl.[4] ..... D05B 21/00; D05B 33/00; D05B 37/00; D05C 15/00

[52] U.S. Cl. ..... 112/121.12; 112/121.24; 112/121.29; 112/122; 112/137; 112/80.3

[58] Field of Search ..... 112/121.11, 121.12, 112/121.15, 121.29, 121.24, 122, 137, 80.3, 80.01

[56] References Cited

U.S. PATENT DOCUMENTS

| | | | |
|---|---|---|---|
| 1,788,417 | 1/1931 | Weis | 112/121.24 |
| 2,317,698 | 4/1943 | Stotz | 112/121.24 X |
| 3,221,685 | 12/1965 | Greenberg | 112/138 |
| 3,223,059 | 12/1965 | Jacobs | 112/121.12 |
| 3,232,256 | 2/1966 | Buckalter | 112/121.15 |
| 3,320,910 | 5/1967 | Tevyaw | 112/138 |
| 3,376,836 | 4/1968 | Nicolay | 112/121.12 X |
| 3,670,675 | 6/1972 | Rovin et al. | 112/121.12 |
| 3,820,484 | 6/1974 | Neill et al. | 112/121.11 X |
| 4,008,672 | 2/1977 | Cianciotti | 112/121.15 X |
| 4,425,858 | 1/1984 | Hargett | 112/121.12 |
| 4,435,837 | 3/1984 | Abernathy | 112/121.12 X |
| 4,498,404 | 2/1985 | Sadeh | 112/121.15 X |
| 4,608,936 | 9/1986 | Ball et al. | 112/121.12 |

*Primary Examiner*—H. Hampton Hunter

*Attorney, Agent, or Firm*—Bell, Seltzer, Park & Gibson

[57] ABSTRACT

An apparatus is provided for automatically fabricating textile articles, such as bath throw rugs and the like. This apparatus includes devices for intermittently feeding continuous textile material suitable for fabricating the articles from a supply position to a cutting position in the apparatus. Devices successively cut slightly oversized textile articles from the continuous textile material in the cutting position. A robot mechanism successively picks-up and transports each cut article from the cutting position to an edge finishing position in the apparatus, rotates the cut articles in a predetermined pattern during edge finishing thereof and then transports the fabricated textile article to a stacking position and releases the fabricating textile article. An edge finishing apparatus receives the slightly oversized cut textile article in the edge finishing position as the article is being rotated by the robot device in its predetermined pattern and includes devices for simultaneously trimming off a predetermined width of the outside edge portion of the textile article, positioning an edge binding tape around the trimmed edge and sewing the edge binding tape to the trimmed edge of the textile article. Control devices are provide for controlling the sequential cycles of operations of the feeding device, the cutting device, the robot mechanism and the edge finishing apparatus for automatic fabrication of the textile article.

13 Claims, 19 Drawing Figures

VACUUM SOURCE
30
31
10
M
13
A

APPARATUS FOR AUTOMATICALLY FABRICATING TEXTILE ARTICLES SUCH AS BATH THROW RUGS AND THE LIKE

FIELD OF THE INVENTION

This invention relates to an apparatus for automatically fabricating textile articles, such as bath throw rugs and the like, having a trimmed outside peripherial edge with edge binding tape sewn therearound.

BACKGROUND OF THE INVENTION

It has previously been the practice in fabricating such textile articles, particularly bath throw rugs and the like, to utilize a number of individual machines, locations an operator steps including cutting a continuous length of textile fabric into individual articles of slightly oversized dimensions. These cut articles were then taken to individual machines which would trim off a predetermined width of the outside edge portion of the textile article, apply an edge binding tape around the trimmed edge of the article and sew the edge binding tape to the trimmed edge of the article to complete fabrication thereof. The fabricated article would then be stacked for packaging, etc.

This type of article fabricating operation was necessarily expensive and time consuming. No automatic fabricating apparatus has been commercially available to applicant's knowledge for automatically performing the above described fabricating steps, nor has an edge finishing apparatus been commercially available which will simultaneously edge trim, apply an edge binding tape and sew the edge binding tape to the trimmed edge automatically and satisfactorily without excessive operator handling.

OBJECTS AND SUMMARY OF THE INVENTION

It is, therefore, an object of this invention to provide an apparatus for automatically performing such fabricating steps in the manufacture of bath throw rugs and the like which will eliminate excessive operator time and expense.

If is a further object of this invention to provide an edge finishing apparatus for use in fabricating such textile articles which will automatically perform the above described edge finishing operations.

By this invention it has been found that this object may be accomplished by providing an apparatus for automatically fabricating textile articles, such as bath throw rugs and the like, having an edge binding tape sewn therearound in which such apparatus includes generally the following.

Means are provided for intermittently feeding continuous textile materials, suitable for fabricating such articles, from a supply to a cutting position in the apparatus. Means successively cut slightly oversized textile articles from the continuous material in the cutting position. Robot means successively pick-up and transport each cut textile article from the cutting position to an edge finishing position in the apparatus, rotate the cut textile article in a predetermined pattern about an axis perpendicular to the faces of the cut textile article during edge finishing thereof, and then transport the fabricated article to a stacking position and release the fabricated article.

Edge finishing means receive the slightly oversized cut textile article in the finishing position as such article is rotated by the robot means in its predetermined pattern and includes means for trimming-off a predetermined width of the outside edge portion of the textile article, means for simulaneously positioning edge binding tape around the outside trimmed edge of the textile article and means for simultaneously sewing the edge binding tape around the outside trimmed edge of the textile article. Means are operatively connected with and control the sequential cycles of operations of the feeding means, the cutting means, the robot means and the edge finishing means for automatic fabrication of the textile articles.

Preferably, the means for trimming-off a predetermined width of the outside edge portion of the textile article of the edge finishing means includes means for disengaging the trimming means when trimming is no longer desired. Preferably, the means for supplying and positioning an edge binding tape around the trimmed edge of the textile article of the edge finishing means includes means for cutting the edge binding tape at the end of a cyle of operation.

In accordance with a preferred embodiment of this invention, the textile material is a tufted pile material, the robot means further rotates the cut textile article in a second predetermined pattern about an axis perpendicular to the faces of the cut textile article after rotation thereof in the first predetermined pattern, and the edge finishing means includes a tufting machine for receiving the textile article during rotation in its second predetermined pattern for applying pile tufts through the edge binding tape sewn around the outside of the trimmed edge of the textile article for providing a tufted pile edge to the fabricated article.

BRIEF DESCRIPTION OF THE DRAWINGS

While some of the objects and advantages of this invention have been set forth above, other objects and advantages will appear as the detailed description of preferred embodiments of this invention continues when taken in conjunction with the accompanying drawings, in which.

DESCRIPTION OF PREFERRED EMBODIMENT

Figures 1, 2:
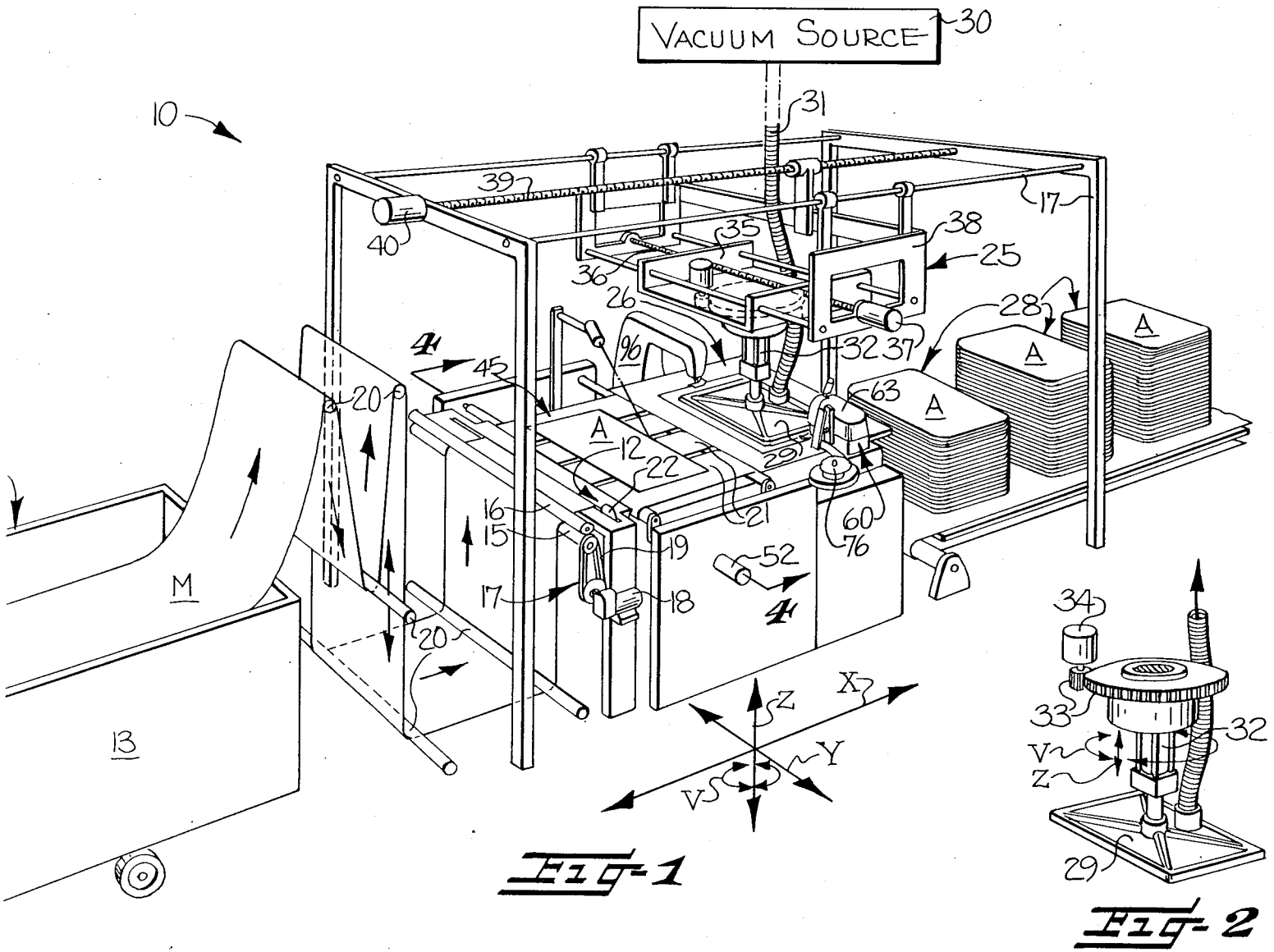
FIG. 1 is a perspective, somewhat schematic, view of an apparatus constructed in accordance with this invention.
FIG. 2 is an enlarged perspective detail of a portion of the robot means utilized in the apparatus of FIG. 1.

Referring now to the drawings, there is illustrated in FIG. 1 an apparatus, generally referred to at 10, for automatically fabricating textile articles A, such as bath throw rugs and the like.

This apparatus 10 includes means for intermittently feeding continuous textile material M suitable for fabricating such articles A from a supply position 11 to a cutting position 12 in the apparatus 10. The supply of the material M can be in any suitable form, such as the dolly 13 illustrated in FIG. 1.

The material M is fed from its supply 13 in the supply position 11 to the cutting position 12 by any suitable means, such as feed rolls 15,16 suitably mounted on a portion of the frame of the apparatus, collectively indicated at 17. The feed rolls 15,16 include suitable drive means, such as the selectively-operated motor 18 and belt and pulley drive 19 carried by the apparatus frame 17 and connected with the feed roll 15. The feed rolls 15,16 intermittently feed the continuous material M around tension rolls 20 onto conveyor belts 46 and past a cutting mechanism 22. This cutting mechanism 22 may be any suitable sort of cutting mechanism including a rotating cutter mounted on a motor belt and pulley arrangement 23 and driven by selectively-operated motor 24, all suitably mounted on apparatus frame 17. The motor driven belt and pulley arrangement 23 will selectively move the rotating cutter 22 transversely across the continuous material M after it has been fed past the cutter 22 by the feed rolls 15,16 to cut the continuous material M into slightly oversized cut textile articles A.

The apparatus 10 further includes robot means 25 mounted on a portion of the apparatus frame 17 for successively picking-up and transporting each cut textile article A from the cutting position 12 to an edge finishing position 26, for rotating the cut textile article A in a predetermined pattern V about an axis perpendicular to the faces of the cut textile article A in the edge finishing position 26, and for then transporting the fabricated textile article A to a stacking position 28 and releasing the fabricated textile article A.

The robot means 25 preferably includes a selectively-operable suction-head end-effector 29 for picking-up, holding and releasing the textile articles A. This suction-head end-effector may be in the form of a flat hollow housing having apertures in the bottom surface thereof (not shown) and connected to a vacuum source 30 through a flexible hose connection 31 to be selectively-operated by a solenoid valve 41 to apply a vacuum within the housing of the end effector 29 to create a suction on the bottom surface thereof when it is desired to pick-up, transport and hold the textile articles and which may be disengaged to shut off the suction when it is desired to release the textile article A.

The robot means 25 also includes devices for selectively moving the robot means 25 in a forward and reverse longitudinal horizontal path of travel X, a forward and reverse transverse horizontal path of travel Y, an up and down vertical path of travel Z, the rotating path of travel V about a vertical axis (all of which are indicated by the arrows in FIGS. 1 and 2), and combinations of such paths of travel to effect the desired transporting and pattern rotation of the textile articles A by the robot means 25.

The means for effecting these paths of travel V, X, Y, Z of the robot means 25 may be any selectively operated drive mechanisms including a pneumatically-operated piston and cylinder device 32 connected to a suitable air source through selectively-operated solenoid valve 42 for carrying the end effector 29 for the up and down vertical path of travel Z. This piston and cylinder mechanism 32 may be connected to and carried by a circular driven gearing arrangement 33 driven by selectively-operated motor 34 for rotating the end effector 29 in its rotating path of travel V about a vertical axis. The gearing arrangement 33 may be carried by a suitable transversely movable carriage 35 mounted on a rotating worm gear 36 which is driven by selectively-operated motor 37 and extends in the transverse directions to move the end effector 29 and other above described mechanisms in a forward and reverse transverse horizontal path of travel Y. These mechanisms may in turn be carried by a carriage 38 which is mounted on another rotating worm gear 39 which is driven by selectively-operated motor 40 and extends in a longitudinal direction and is carried by a portion of the frame 17 for moving the end effector 29 and other above described mechanisms in a forward and reverse longitudinal horizontal path of travel X. Thus, by selective actuation of the piston and cylinder device 32, rotating gear and motor device 33,34, worm gear and motor device 36,37, and worm gear and motor device 39,40, the above described paths of travel V, X, Y, Z for the end effector 29 and cut textile article A carried thereby can be effected.

Figure 3:
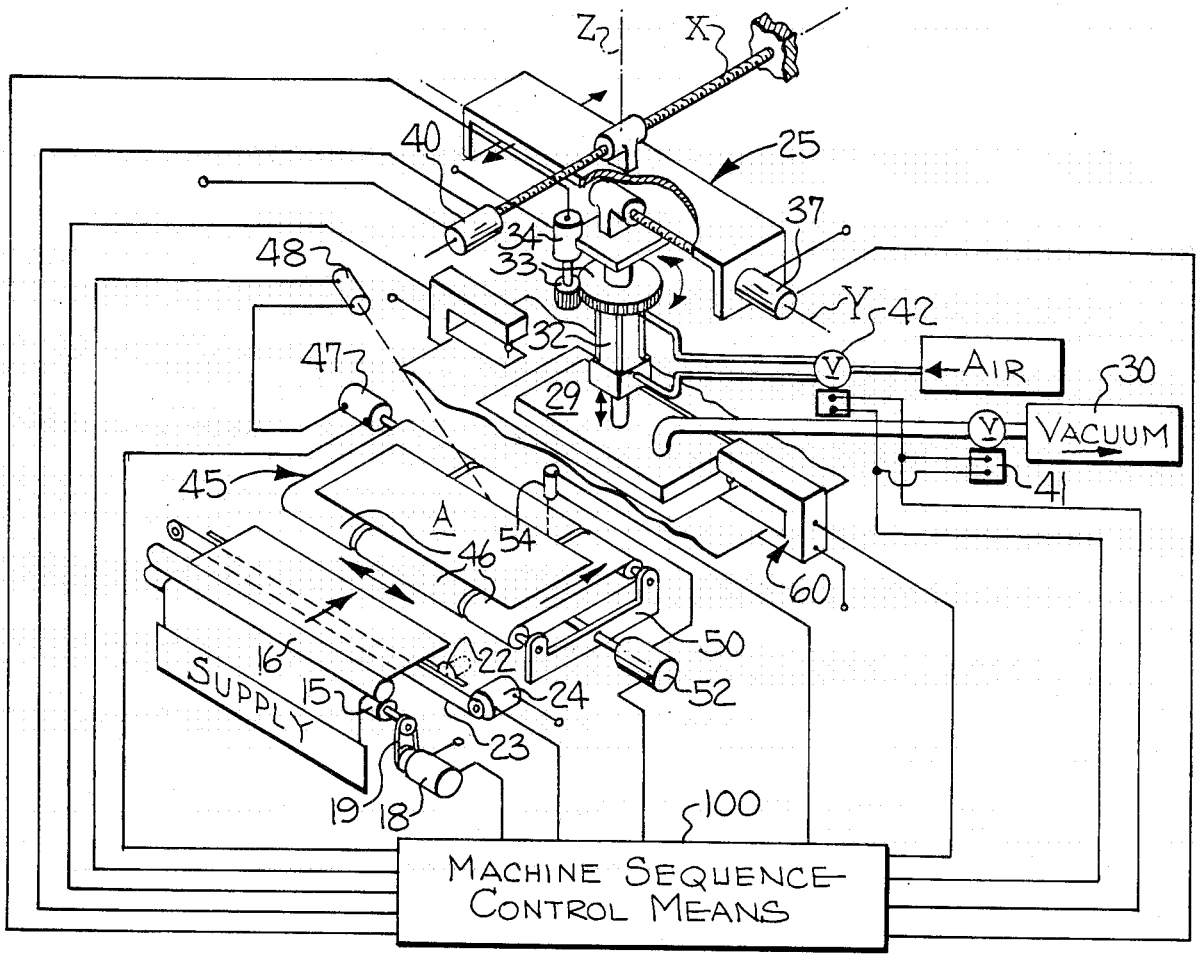
FIG. 3 is a schematic perspective view of the control means utilized for the apparatus of FIG. 1.
Figure 4:
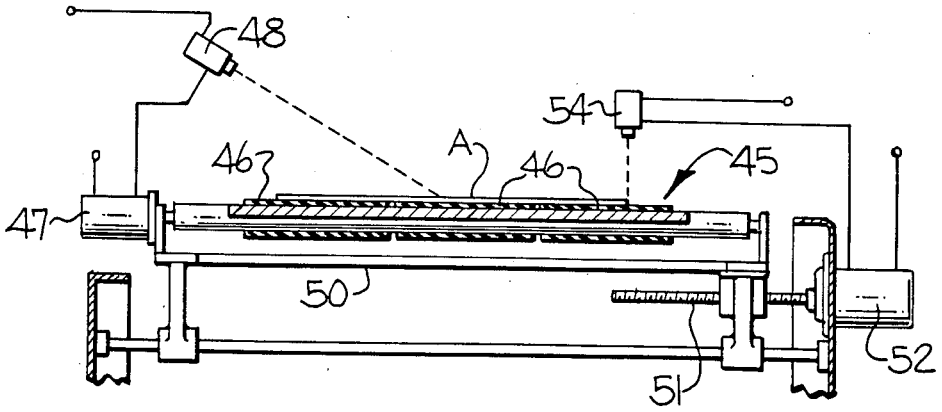
FIG. 4 is a sectional schematiac view through the apparatus and taken generally along the line 4—4 of FIG. 1.

In order to properly position the cut article A for pick-up by the robot means 25, the apparatus 10 preferably includes means 45 for positioning the cut textile article A in a predetermined longitudinal and transverse position for pick-up by the robot means 25. This positioning means 45 may comprise means for moving the textile article longitudinally from the cutting position and as disclosed in FIGS. 1, 3 and 4, is in the form of endless conveyor belts 46 driven by selectively-operated motor 47. The positioning means further includes means for sensing the cut textile article A when it has moved longitudinally to the predetermined position which may be in the form of a photoelectric cell 48 for sensing the forward edge of the cut textile article A when it has moved longitudinally forwardly to the predetermined position and which is operatively connected to the motor 47 for stopping forward movement of the conveyor belts 46. The positioning means further includes means for moving the cut textile article A transversely from the cutting position and, as illustrated in FIGS. 1, 3 and 4, this means includes a carriage device 50 mounted on a worm gear 51 driven by selectively-operated motor 52 and extending transversely of the cut textile article A for moving the conveyor belts 46 transversely of the textile article A to the predetermined position. There is further included a means, in the form of a photoelectric cell 54 operatively connected to the motor 52, for sensing the cut textile article A when it has moved transversely to the predetermined position and for stopping operation of the motor 52 to stop transverse movement of the cut textile article A when it has reached the predetermined position.

Figure 5:
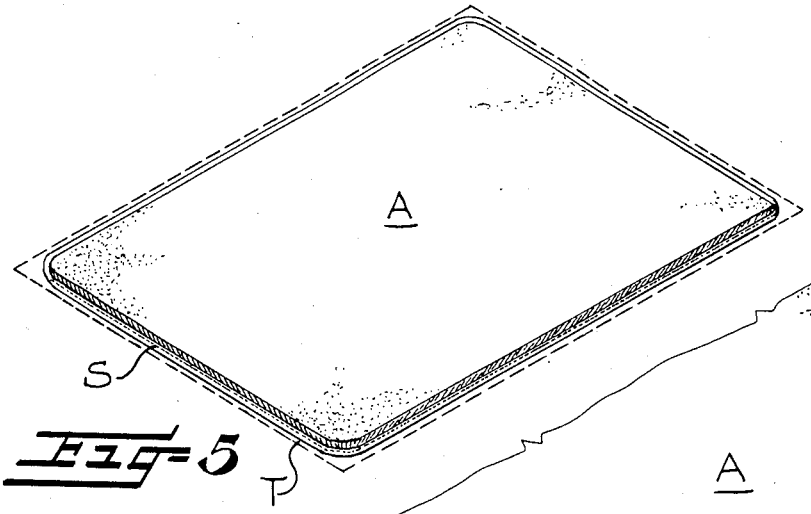
FIG. 5 is a perspective view of a textile article, such as a bath throw rug, constructed in accordance with this invention.
Figure 6:
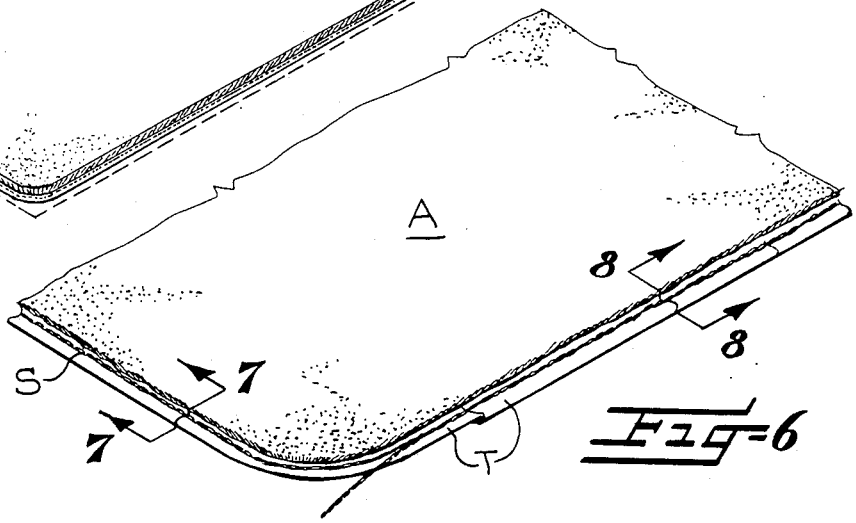
FIG. 6 is an enlarged perspective view of one corner portion of the fabricated textile article of FIG. 5.
Figure 7:
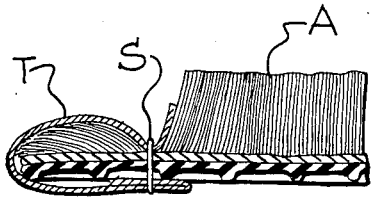
FIG. 7 is a sectional view taken generally along the line 7—7 of FIG. 6.
Figure 11:
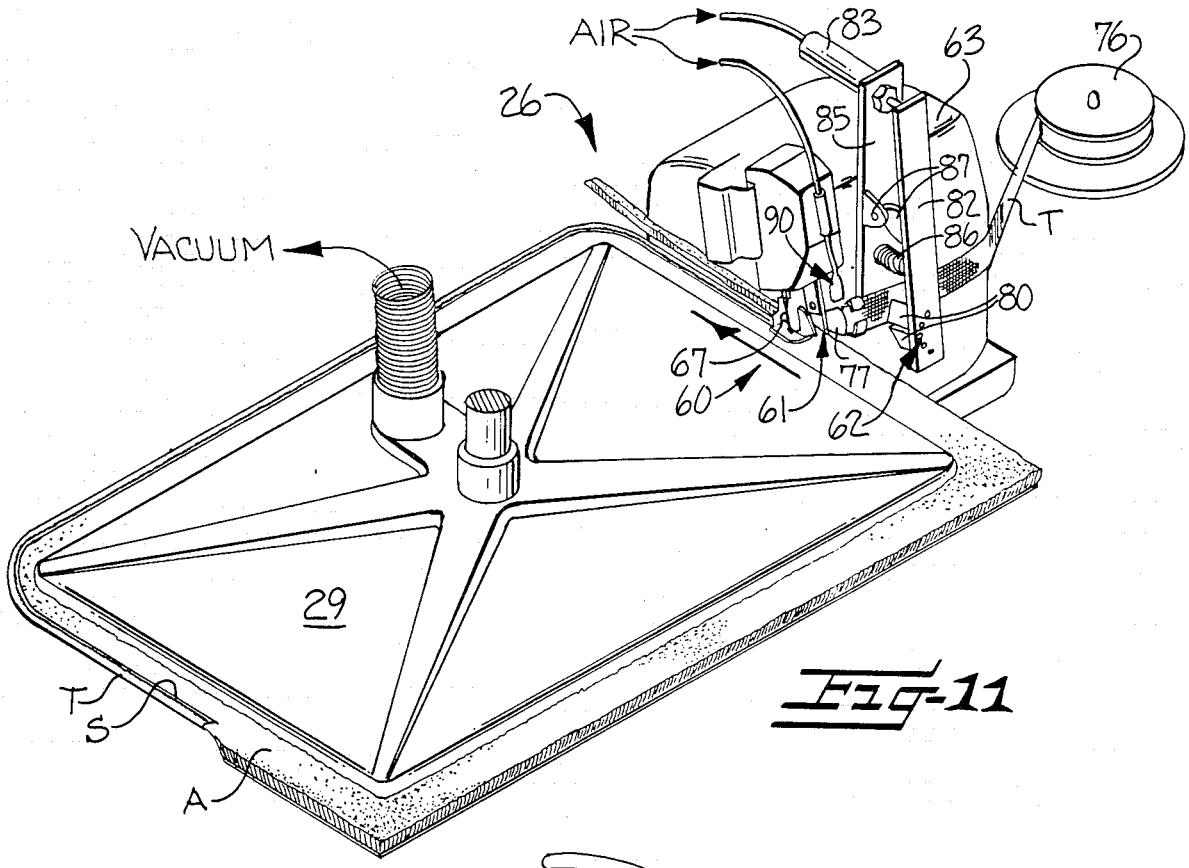
FIG. 11 is a partial perspective view of the end effector of the robot means holding a textile article for rotating the textile article through the edge finishing machine of this invention.
Figure 12:
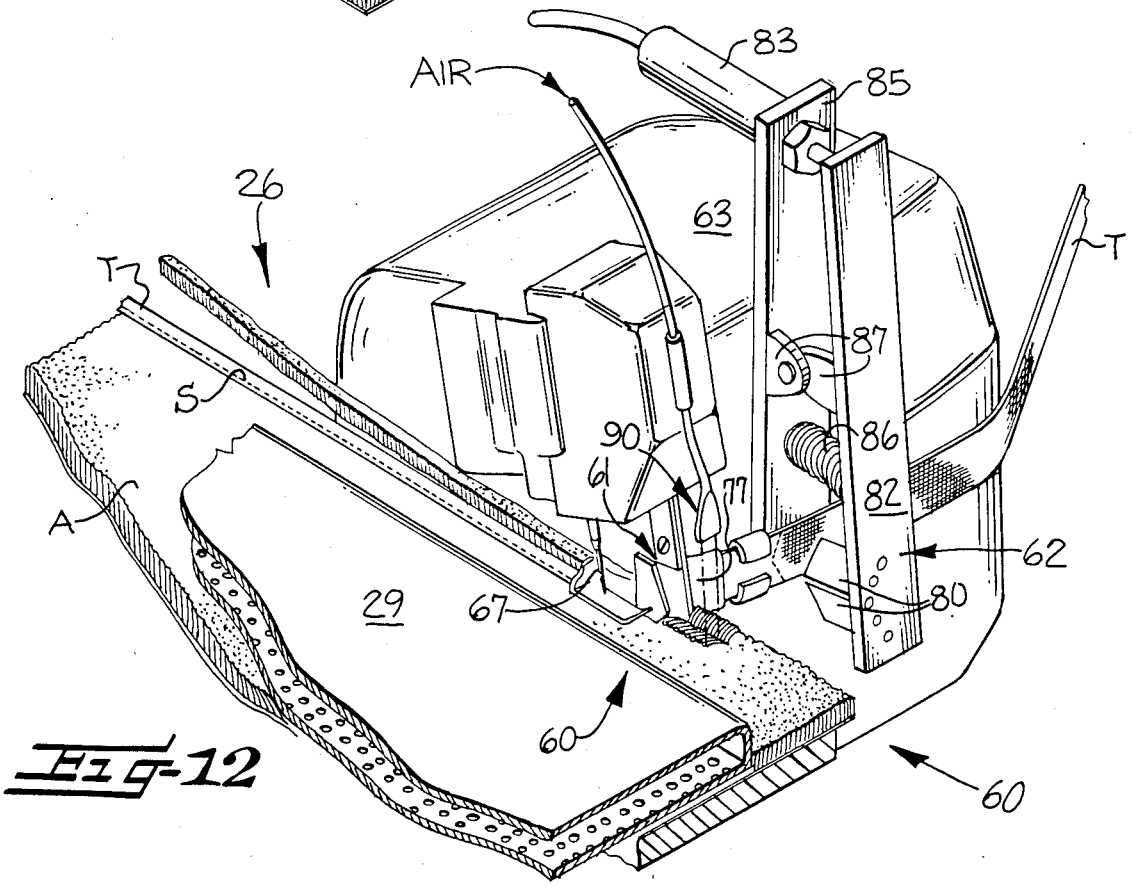
FIG. 12 is an enlarged perspective view of the edge finishing machine performing its edge finishing operations on the textile article.
Figure 13:
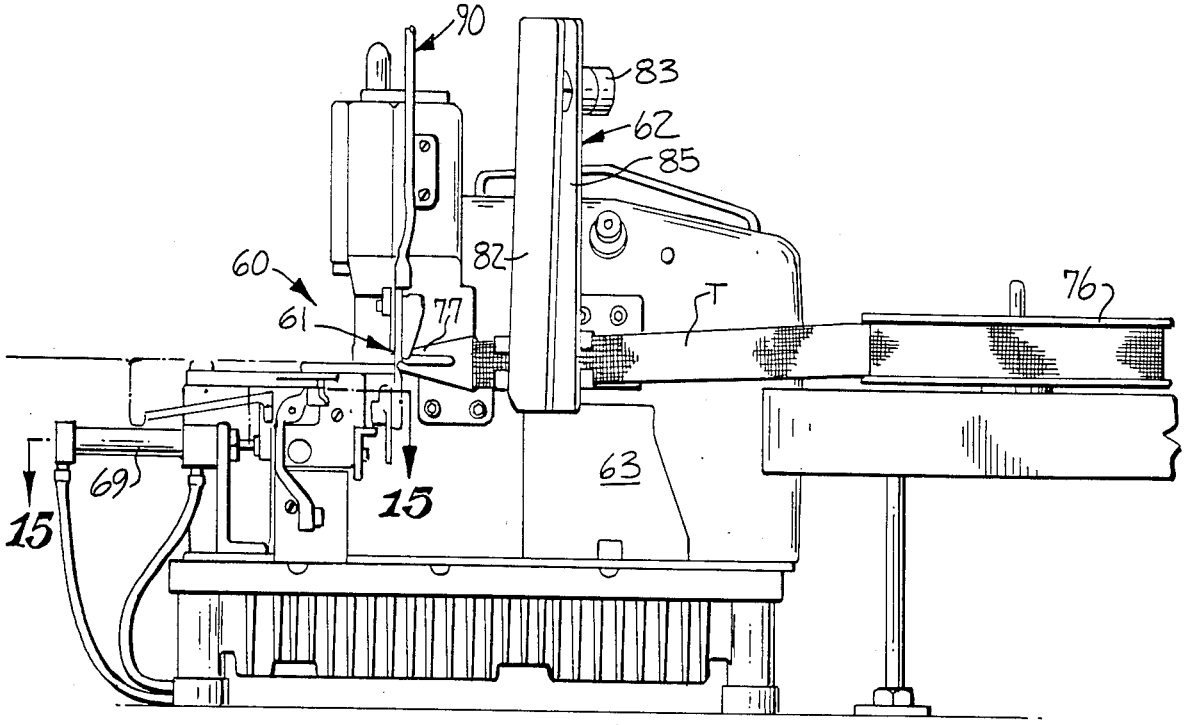
FIG. 13 is a front elevational view of the edge finishing machine of FIGS. 11 and 12.

The apparatus 10 further includes edge finishing means 60 for receiving the slightly oversized cut textile article A in the edge finishing position 26 as such article A is being rotated by the robot means 25 in its predetermined pattern and includes a trimming mechanism 61 for trimming off a predetermined width of the outside edge portion of the textile article A, an edge binding tape positioning mechanism 62 for simultaneously positioning an edge binding tape T around the trimmed edge of the article A, and a sewing machine 63 for sewing the edge binding tape to the trimmed edge of the article A by stitches S. As may be seen particularly in FIGS. 11–13, this edge finishing means 60 including trimming mechanism 61, edge binding tape positioning mechanism 62 and sewing machine 63 are all part of a unitary edge finishing apparatus 60 and operate simultaneously for performing the above edge finishing operations to form a fabricated textile article A having a trimmed edge with edge binding tape T sewn by stitches S around such trimmed edge, as illustrated in FIGS. 5–7.

The edge trimming means 61 may comprise reciprocating cooperating blades 65, 66 in which blade 65 is suitably attached to sewing machine 63 drive mechanisms (not shown) for reciprocation up and down in a vertical path of travel (FIGS. 15, 16) into and out of cutting engagement with normally stationary blade 66. The cutting blades 65, 66 are positioned just prior to the needle 67 and other stitching mechanisms of the sewing machine 63 for trimming a predetermined width of the outside edge portion of the textile article A as such article A is fed through the sewing machine 63 of the edge finishing apparatus 60.

Figure 15:
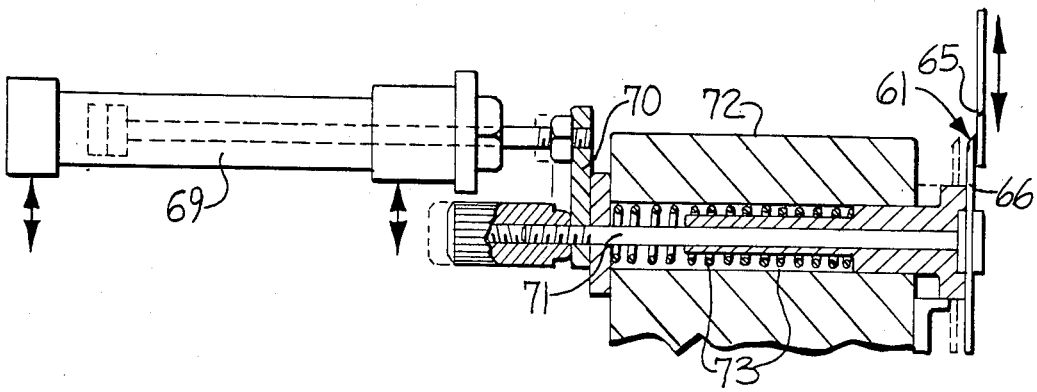
FIG. 15 is a sectional view taken generally along the line 15—15 of FIG. 13.
Figure 16:
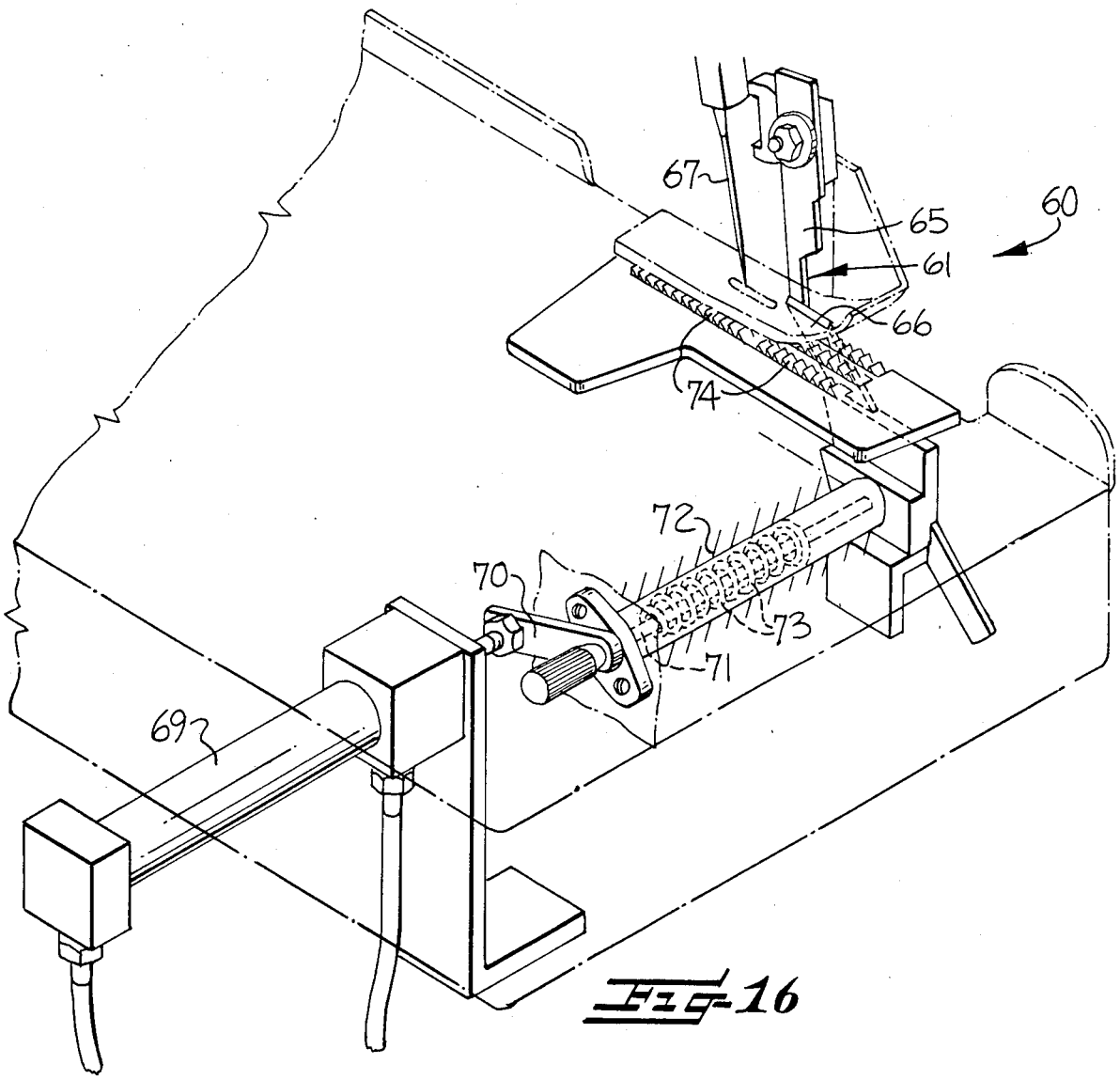
FIG. 16 is a perspective detail of the trimming device utilized in the edge finishing machine.

The edge trimming means 61 further includes means for disengaging said edge trimming means at the end of a desired cycle of operation or preferably after the entire peripheral edge of the article A has been fed through the edge finishing apparatus 60. This means for disengaging the trimming means 61 may comprise a pneumatically-operated selectively-operated piston and cylinder 69 having the piston thereof connected to an arm 70 which is in turn connected to a rod 71 contained within a cylindrical hollow housing 72 and connected at its outer end to the blade 66. A suitable spring 73 may be contained within the housing 72 for biasing the rod 71 and thus the blade 63 into its normal cutting position (FIGS. 15, 16). However, when the piston and cylinder mechanism 69 is selectively-operated, the rod 71 and the blade 66 will be moved to the dotted line positions shown in FIG. 15 to move the cutting blade 66 out of cutting engagement with the reciprocating blade 65 to disengage the trimming mechanism. Control of this means for disengaging the trimming mechanism 61 after the textile article has been rotated 360° or otherwise, can be contained within the edge finishing mechanism 60 and could be associated with operation of the feed dogs 74 of the sewing machine 63 and would include means (not shown) for adjustment to accommodate different textile articles A. The controls may also be tied into the overall machine sequence control means of the edge finishing apparatus 60, to be described below, for the entire textile article fabricating apparatus 10. A full illustration and description of such controls are not believed necessary for full understanding of this invention.

Figure 14:
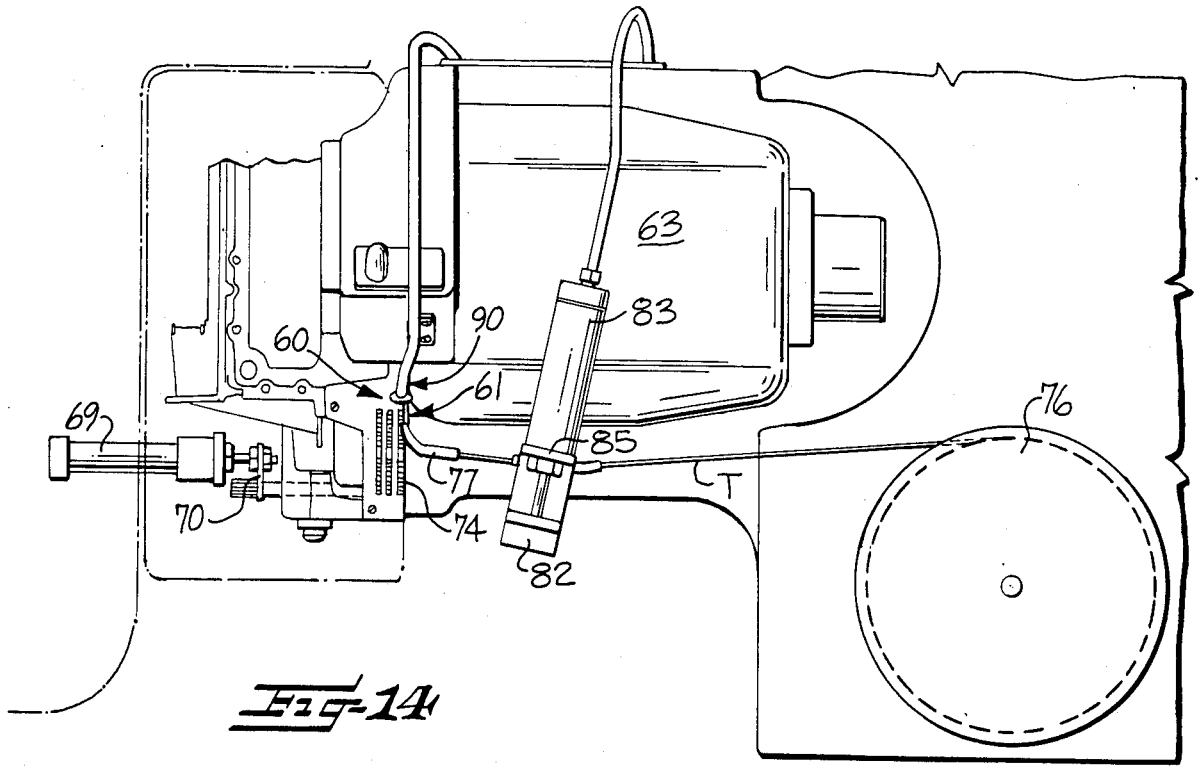
FIG. 14 is a top plan view of the edge finishing machine of FIG. 13.

The edge binding tape supplying and positioning means may be in the form of a suitable supply of edge binding tape T, such as a spool 76 (FIGS. 13, 14), which supply the edge binding tape T to a suitable guiding device 77 which guides the edge binding tape around and positions the edge binding tape T in a suitable, generally U-shaped configuration around the outside trimmed edge of the textile article A between the edge trimming blades 65, 66 and the sewing needle 67 of the sewing machine 63 so that the edge binding tape T is properly positioned on the trimmed edge of the textile article after trimming by the edge trimming means 61 and prior to stitching by the sewing machine 63.

Figure 17:
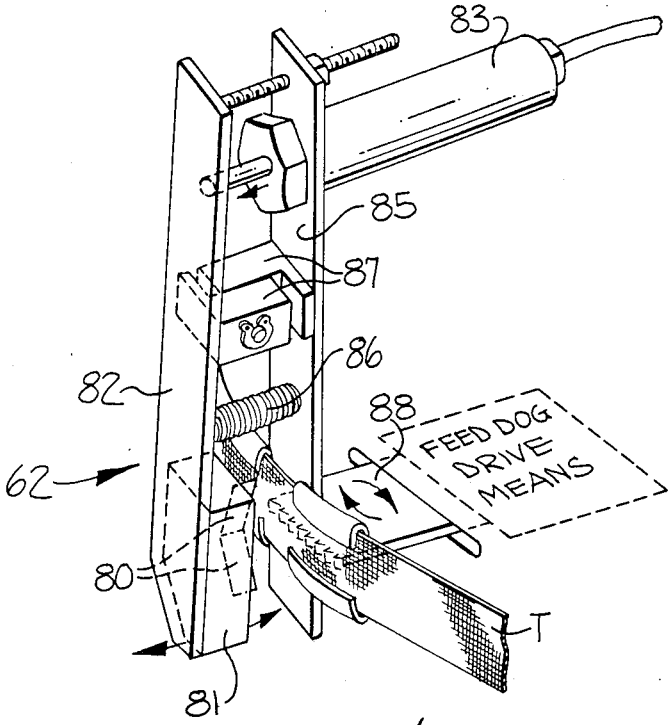
FIG. 17 is a perspective detail of the edge binding tape cutting device utilized in the edge finishing machine.

The edge binding tape supply and positioning means 62 further includes means for cutting the edge binding tape T after the edge binding tape T has been positioned around at least the entire peripheral trimmed edge of the textile article A. This cutting means, as shown particulary in FIGS. 17, 18, may be in the form of a cutting blade 80 suitably carried by a block 81 mounted on a plate 82 which is in turn pivotally carried by the piston of a selectively-operated piston and cylinder mechanism 83. The cylinder of the piston and cylinder mechanism 83 is carried by a plate 85 which also provides an anvil surface or cutting surface for cooperation with the blade 80. The plates 82, 85 are biased apart in a noncutting position by a spring 86 extending therebetween and a guide 87 may be provided for the plates 82, 83. with this arrangement, when the piston and cylinder mechanism 83 is selectively-operated, the piston thereof will move the plate 82 and the cutting blade 80 so that the cutting blade 80 will contact the plate 85, as may be clearly seen in FIG. 17. Inasmuch as the edge binding tape T is fed between the plates 82, 85 by a suitable feeding mechanism, such as feed dog device 88, the tape T will be cut when the piston and cylinder mechanism 83 is selectively-operated.

Figure 18:
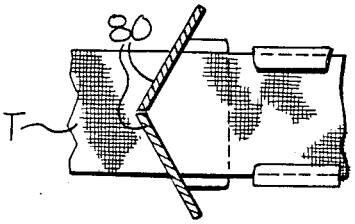
FIG. 18 is a sectional detail through a portion of the edge binding tape cutting device.
Figure 19:
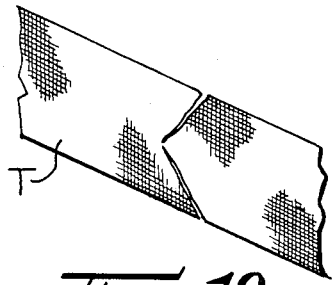
FIG. 19 is a perspective view of the edge binding tape after having been cut by the cutting device.

The cutting blade 80 is preferably in the form of a generally V-shaped blade with a cut-out portion in the middle thereof so that the edge binding tape T will be transversely cut from each outside edge toward the middle thereof while leaving a small center section uncut, as shown in FIGS. 18, 19. This will allow the edge binding tape T to be fed from the cutting mechanism through the guide 77 and into position around the trimmed edge of the article A for breaking under tension when the cut portion of the edge binding tape T reaches the textile article A and to leave a leading edge of the tape T in position through the guide 77 for the next textile article A to be fabricated. Controls for the piston and cylinder mechanism 83 may also be contained within the edge finishing apparatus 60 and may be keyed to the feed of the textile article A through the sewing machine 63 by the feed dogs 74 or otherwise. Also, controls for the piston and cylinder mechanism 83 for the edge binding tape cutting means may also be tied into the overall machine sequence control means, to be described below, with respect to the overall textile article fabricating apparatus 10. It is not believed that an illustration and description of such control means is necessary for a full understanding of this invention.

Figure 8:
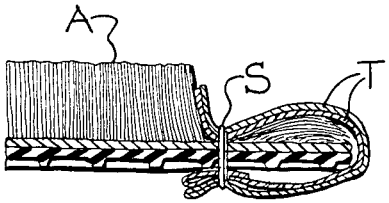
FIG. 8 is a sectional view taken generally along the line 8—8 of FIG. 6.

In fabricating textile articles A, such as bath rugs, it is often desired to stitch the edge binding tape around a small portion of the leading trimmed edge to which edge binding tape T has already been positioned, as shown in FIGS. 6 and 8. For this purpose, the robot means 25 will be controlled to rotate the textile article A slightly greater than a 360° path of rotation, the above described means for disengaging the edge trimming means 61 would be controlled to disengage the edge trimming means 61 after the entire peripheral edge of the textile article has been fed through the edge finishing means 60 and rotated by the robot means 25 in a 360° path of rotation, and the above described means for cutting the edge binding tape T would be controlled to cut the edge binding tape T so that an additional segment of edge binding tape T is provided for being positioned by the edge binding tape positioning means 62 around a small portion of the leading trimmed edge of the texticle article A to which the edge binding tape has already been positioned.

When the textile article A being fabricated is in the form of a tufted pile material, as shown in FIGS. 7 and 8, for the fabrication of a bath rug or the like, the edge finishing apparatus 60 may further include means 90 positioned slightly in advance of the textile article edge trimming means 61 and the edge binding tape applying means 62 for applying a stream of air against the pile face of the textile article A (FIG. 12) along the trim line to open up the pile of the textile article A along such trim line to facilitate trimming of the textile article A without undesirable trimming of the pile. This means for applying a stream of air 90 may be in the form of a suitable nozzle connected to an air supply source.

Figure 9:
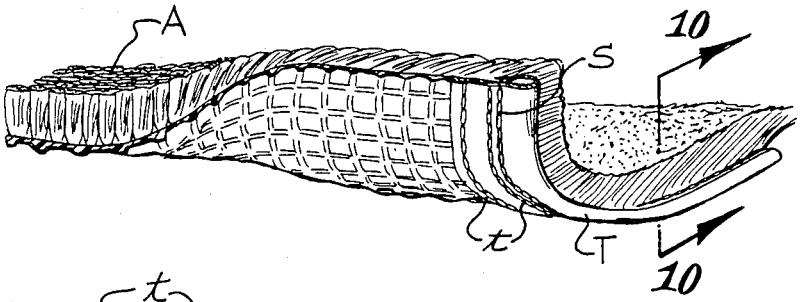
FIG. 9 is a partial perspective view of a portion of a modified textile article which can be produced with the apparatus of FIG. 1.
Figure 10:
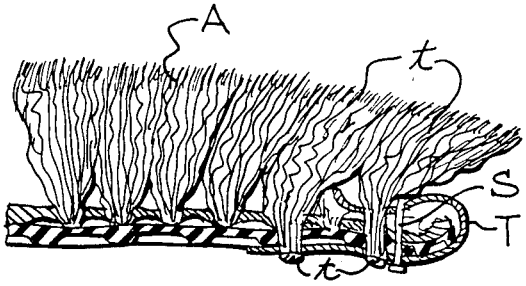
FIG. 10 is a sectional view taken generally along the line 10—10 of FIG. 9.

When the textile article A being fabricated by the apparatus 10 is in the form of the tufted pile article, particularly a bath throw rug, it is often desirable to apply extra pile tufts through the edge binding tape T after having been stitched around the trimmed edge of the textile article A, as shown in FIGS. 9 and 10. For this purpose, the robot means 25 would be controlled to further rotate the cut textile article A in a second predetermined pattern V about an axis perpendicular to the faces of the cut textile article A after rotation thereof through the above described edge finishing 60. The edge finishing means 60 would also include a separate tufting machine 96 positioned in the apparatus 10 in the edge finishing position 26, but on the other side of the apparatus 10 (FIGS. 1 and 3) for receiving the textile article A as such article A is being rotated by the robot means 25 in the second predetermined pattern V for applying tufts t through the edge binding tape T sewn around the outside of the trimmed edge of the textile article A.

The article fabricating apparatus 10 further includes machine sequence control means 100 (FIG. 3) operatively connected with and controlling the sequential cycles of operation of the material feeding means through motor 18, the article cutting means through motor 23, the cut article positioning means through motors 47, 52, the robot means through solenoid valves 41, 42 and motors 34, 37, 40, and to the edge finishing means 60 through internal drives.

This machine sequence control means 100 may be in the form of any electronic control means for sequencing the operations of the above described mechanisms. These electronic control means are generally commercially available and an illustration and description thereof herein is not deemed necessary for a full understanding of this invention. Schematic electrical connections have been shown in FIG. 3 from such machine sequence control means to all of the above described mechanisms.

Thus, this invention has provided an apparatus 10 for automatically fabricating textile articles A, such as bath throw rugs and the like, having a trimmed outside peripheral edge with edge binding tape T sewn therearound by stiches S, which will automatically perform the fabricating operations in the manufacture of such textile articles A to eliminate heretofore necessary operator time and expense. Further, an edge finishing apparatus 60 has been provided for use in fabricating such textile articles A which will automatically form the edge finishing functions of trimming off a predetermined width of the outside edge portion of the textile article A, simultaneously positioning an edge binding tape T around the trimmed edge of the textile article A and simultaneously sewing the edge binding tape T to the trimmed edge of the textile article A, thus eliminating heretofore required manual operations in such edge finishing operations.

In the drawings and specification there has been set forth preferred embodiments of this invention, and although specific terms are employed, they are used in a generic and descriptive sense only and not for purposes of limitation, the scope of the invention being defined in the following claims.

That which we claim is:

1. Apparatus for automatically fabricating textile articles, such as bath throw rugs and the like; said apparatus comprising:

means for intermittently feeding continuous textile material suitable for fabricating such articles from a supply position to a cutting position in said apparatus;

means for successively cutting slightly oversized textile articles from the continuous textile material in the cutting position;

robot means for successively picking-up and transporting each cut textile article from the cutting position to an edge finishing position in said apparatus, for rotating the cut textile article in a predetermined pattern about an axis perpendicular to the faces of the cut textile article during edge finishing thereof, and for then transporting the fabricated textile article to a stacking position and releasing the fabricated textile article;

edge finishing means for receiving the slightly oversized cut textile article in the edge finishing position as such article is being rotated by said robot means in its predetermined pattern and comprising means for trimming off a predetermined width of the outside edge portion of the textile article, means for simultaneously positing an edge binding tape around the trimmed edge of the textile article, and means for simultaneously sewing the edge binding tape to the trimmed edge of the textile article; and means operatively connected with and controlling the sequential cycles of operations of said feeding means, said cutting means, said robot means, and said edge finishing means for automatic fabrication of the textile articles.

2. Apparatus for automatically fabricating textile articles, as set forth in claim 1, in which the textile material is a tufted material, in which said robot means further rotates the cut textile article in a second predetermined pattern about an axis perpendicular to the faces of the cut textile article after rotation thereof in the first predetermined pattern through said edge finishing means, and in which said edge finishing means includes a separate tufting machine means for receiving the textile article as such article is being rotated by said robot means in the second predetermined pattern for applying tufts through the edge binding tape sewn around the outside of the trimmed edge of the textile article.

3. Apparatus for automatically fabricating textile articles, as set forth in claim 1, in which said robot means includes a selectively-operable suction-head end-effector means for picking-up, holding and releasing the textile articles.

4. Apparatus for automatically fabricating textile articles, as set forth in claim 1, 2 or 3, in which said robot means includes selectively-operable means for moving said robot means in an up and down vertical path of travel, a forward and reverse longitudnial horizontal path of travel, a forward and reverse transverse horizontal path of travel, a rotating path of travel about a verticle axis, and combinations of such paths of travel to effect the desired transporting and pattern rotation of the textile article by said robot means.

5. Apparatus for automatically fabricating textile articles, as set forth in claim 1, in which said robot means rotates the textile article slightly greater than a 360° path of rotation, and in which said edge finishing means further includes means for disengaging said trimming means after the entire peripheral edge of the article has been fed through said edge finishing means and rotated by said robot means in a 360° path of rotation, and in which said edge binding tape positioning means also positions the edge binding tape around a small portion of the leading trimmed edge to which edge binding tape has already been positioned and includes means for cutting the edge binding tape at the end of a cycle of operation.

6. Apparatus for automatically fabricating textile articles, such as bath throw rugs and the like, having an edge binding tape sewn therearound; said apparatus comprising:

means for intermittently feeding continuous textile material suitable for fabricating such articles from a supply position to a cutting position in said apparatus;

means for successively cutting slightly oversized textile articles from the continuous textile material in the cutting position;

robot means for successively picking-up and transporting each cut textile article from the cutting position to an edge finishing position in said apparatus, for rotating the cut textile article in a desired pattern slightly greater than 360° about an axis perpendicular to the faces of the cut textile articles during edge finishing thereof, and for then transporting the fabricated textile article to a stacking position and releasing the fabricated textile article, said robot means comprising a selectively-operable suction-head end-effector means to effect picking-up, holding and releasing of the textile article, selectively-operable means for moving said robot in an up and down vertical path of travel, a forward and reverse longitudinal horizontal path of travel, a forward and reverse transverse horizontal path of travel, a rotating path of travel about a vertical axis, and combinations of such paths of travel to effect the desired transporting and pattern rotation of the textile article by said robot means;

edge finishing means for receiving the slightly oversized cut textile article in the edge finishing position as such article is being rotated by said robot means in its predetermined pattern and comprising means for trimming-off a predetermined width of the outside edge portion of the textile article and including means for disengaging said trimming means after the entire peripheral edge of the article has been fed through said edge finishing means, means for simultaneously positioning an edge binding tape around the trimmed edge of the textile article and around a small portion of the lending trimmed edge to which edge binding tape has already been positioned after said robot means has rotated the textile article 360° through said finishing means and including means for cutting the edge binding tape at the end of a cycle of operation, and means for simultaneously sewing the edge binding tape to the trimmed edge of the textile article; and means operatively connected with and controlling the sequential cycles of operations of said feeding means, said robot means, and said edge finishing means for automatic fabrication of the textile articles.

7. Apparatus for automatically fabricating pile bath throw rugs and the like having an edge binding tape sewn therearound with pile tufts inserted therein; said apparatus comprising:

means for intermittently feeding continuous tufted pile textile material suitable for fabricating such articles from a supply position to a cutting position in said apparatus;

means for successively cutting slightly oversized textile articles from the continuous material in the cutting position;

robot means for successively picking-up and transporting each cut article from the cutting position to an edge finishing position in said apparatus, for rotating a cut textile article in first predetermined pattern slightly greater than 360° about an axis perpendicular to the faces of the cut article during edge finishing thereof, for rotating the article in a second predetermined pattern about an axis perpendicular to the faces of the article after rotation thereof in the first predetermined pattern during edge finishing thereof, and for then transporting the fabricated article to a stacking position and releasing the fabricated textile article, said robot means comprising a selectively-operable suction-head end-effector means to effect picking-up, holding and releasing of the article, selectively-operable means for moving said robot in an up and down vertical path of travel, a forward and reverse longitudinal horizontal path of travel, a forward and reverse transverse horizontal path of travel, a rotating path of travel about a vertical axis, and combinations of such paths of travel to effect the desired transporting and pattern rotation of the article by said robot means;

edge finishing means for receiving the slightly oversized cut textile article in the edge finishing position as such article is being rotated by said robot means in its predetermined patterns and comprising means for trimming-off a predetermined width of the outside edge portion of the textile article as the textile article is rotated in its first predetermined pattern and including means for disengaging said trimming means after the entire peripherial edge of the article has been fed through said trimming means, means for simultaneously positioning and edge binding tape around the trimmed edge of the article as the article is being rotated in its first predetermined pattern and around a small portion of the leading trimmed edge to which edge binding tape has already been positioned after rotation of the textile article 360° and including means for cutting the edge binding tape at the end of a cycle of operation, means for simultaneously sewing the edge binding tape to the trimmed edge of the article as the article is rotated in its first predetermined pattern, and separate tufting machine means for receiving the article as the article is rotated in its second predetermined pattern of rotation for applying pile tufts through the edge binding tape sewn around the outside of the trimmed edge of the article; and means operatively connected with and controlling the sequential cycles of operations of said feeding means, said robot means and said edge finishing means for automatic fabrication of the bath throw rug.

8. Apparatus for automatically fabricating textile articles, as set forth in claim 1, 6 or 7 in which said apparatus further includes means for positioning the cut textile article in a predetermined longitudinal and transverse position for pick-up by said robot means.

9. Apparatus for automatically fabricating textile articles, as set torth in claim 8, in which said positioning means comprises means for moving the cut textile article longitudinally from the cutting position, means for sensing the cut textile article when it has moved longitudinally to the predetermined position and for stopping said longitudinal moving means, means for moving the cut textile article transversely from the cutting position, and means for sensing the cut textile article when it has moved transversely to the predetemined position and for stopping said transverse moving means.

10. Edge finishing apparatus for use in fabricating a textile article, such as a bath throw rug and the like; said edge finishing apparatus comprising:

means for feeding an outside edge portion of the textile article through said apparatus;

means for trimming-off a predetermined width of the outside edge portion of the textile article as the textile article is fed through said apparatus;

means for simulataneously supplying and positioning an edge binding tape around the trimmed edge of the textile article as the textile article is fed through said apparatus;

means for sewing the edge binding tape to the trimmed edge of the textile article as the textile article is fed through said apparatus; and means for cutting the edge of the binding tape after the tape has been applied to the entire circumference of the article; and means for selectively disengaging said trimming-off means upon completion of trimming the entire circumference of the article to prevent cutting of the tape as the portion of the trimmed edge to which edge binding tape has been previously applied is advanced through said apparatus.

11. Edge finishing apparatus for use in fabricating a textile article, such as a bath throw rug and the like; said edge finishing apparatus comprising:

means for feeding the entire outside peripheral portion of the textile article through said apparatus in a slightly greater than 360° path of rotation of the textile article;

means for trimming-off a predetermined width of the outside edge portion of the textile article as the textile article is fed through said apparatus and including means for disengaging said trimming means after the entire peripheral edge of the article has been fed through said apparatus;

means for supplying and positioning an edge binding tape around the trimmed edge of the textile article as the textile article is fed through said apparatus and around a small portion of the leading trimmed edge to which edge binding tape has already been positioned and including means for cutting the edge binding tape at the end of a cycle of operation; and means for sewing the edge binding tape to the trimmed edge of the textile article as the textile article is fed through said apparatus.

12. Apparatus, as set forth in claim 10 or 11, in which the textile article is a pile material, and in which said apparatus further includes means positioned slightly in advance of said edge trimming means and said edge binding tape applying means for applying a stream of air against the pile face of the textile article along the trim line to open up the pile of the textile article along the trim line to facilitate trimming of the textile article without undesirable trimming of the pile.

13. Apparatus, as set forth in claim 10 or 11, in which means for cutting the edge binding tape comprises cutting means for cutting the binding transversely from each outside edge toward the middle thereof while leaving a small center section uncut for breaking under tension when the cut portion is fed to the textile article and to leave a leading edge of the tape in position for the next textile article to be fabricated.

* * * * *

UNITED STATES PATENT AND TRADEMARK OFFICE

CERTIFICATE OF CORRECTION

PATENT NO. : 4,688,499

DATED : August 25, 1987

INVENTOR(S) : Lawrence Carroll Moore, et al.

It is certified that error appears in the above-identified patent and that said Letters Patent is hereby corrected as shown below:

On the title page the following references should be added.

| | | |
|---|---|---|
| 1,114,082 | 10/14 | Weis |
| 1,440,343 | 12/22 | DeVoe |
| 3,116,705 | 1/64 | Kosrow |
| 3,174,447 | 3/65 | Bono |
| 3,191,557 | 6/65 | Moore |
| 3,467,037 | 9/69 | Frydryk |
| 3,696,765 | 10/72 | Bernewasser |
| 3,796,171 | 3/74 | Arbter |
| 3,871,307 | 3/75 | Scott, et al |
| 3,871,309 | 3/75 | Frost |

The Singer Company, "MARS Robotic Systems by Singer...A New Concept in Flexible Factory Automation!" Form No. IPD 704-85

UNITED STATES PATENT AND TRADEMARK OFFICE

CERTIFICATE OF CORRECTION

PATENT NO. : 4,688,499

DATED : August 25, 1987

INVENTOR(S) : Lawrence Carroll Moore, et al

It is certified that error appears in the above-identified patent and that said Letters Patent is hereby corrected as shown below:

Prince, "Single Needle Edge Taping Machine with Front Cutter"

Signed and Sealed this

First Day of August, 1989

*Attest:*

*Attesting Officer*

DONALD J. QUIGG

*Commissioner of Patents and Trademarks*